US006617940B2

(12) United States Patent
Stenberg

(10) Patent No.: US 6,617,940 B2
(45) Date of Patent: Sep. 9, 2003

(54) SYSTEM AND METHOD FOR FEEDING MULTIPLE BROADCAST ANTENNAS UTILIZING A SINGLE FEED LINE

(75) Inventor: James T. Stenberg, Portland, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/828,479

(22) Filed: Apr. 9, 2001

(65) Prior Publication Data

US 2002/0021187 A1 Feb. 21, 2002

Related U.S. Application Data

(63) Continuation-in-part of application No. 09/639,322, filed on Aug. 16, 2000.

(51) Int. Cl.[7] ..... H01P 1/213; H01Q 5/00

(52) U.S. Cl. ..... 333/134; 348/723; 348/21

(58) Field of Search ..... 333/206, 207, 333/126, 127, 129, 132, 134; 348/723, 608, 487, 470, 426, 21; 343/890

(56) References Cited

U.S. PATENT DOCUMENTS

| | | | | | |
|---|---|---|---|---|---|
| 3,271,705 | A | * | 9/1966 | Karkar | 333/176 |
| 5,267,234 | A | * | 11/1993 | Harrison | 370/38 |
| 5,418,506 | A | * | 5/1995 | Mahnad | 333/134 |
| 5,774,193 | A | * | 6/1998 | Vaughan | 348/723 |
| 6,278,498 | B1 | * | 8/2001 | Neff | 348/723 |

* cited by examiner

*Primary Examiner*—Robert Pascal
*Assistant Examiner*—Stephen E. Jones
(74) *Attorney, Agent, or Firm*—Baker & Hostetler LLP

(57) ABSTRACT

A system and method for utilizing a single feed line for feeding multiple UHF, VHF, and FM broadcast antennas. The system and method employ notch, lowpass, and band-pass filters in conjunction with a splitter to separate two channels transmitted over the same antenna feed line.

17 Claims, 3 Drawing Sheets

SYSTEM AND METHOD FOR FEEDING MULTIPLE BROADCAST ANTENNAS UTILIZING A SINGLE FEED LINE

PRIORITY CLAIM

This application is a Continuation in Part of U.S. patent application Ser. No. 09/639,322, entitled Signal Separator and Bandpass Filter, filed Aug. 16, 2000, the disclosure of which is incorporated herein by reference.

FIELD OF THE INVENTION

The present invention relates to broadcast antennas. More particularly, the present invention relates to a system and method for utilizing a single feed line for feeding multiple broadcast antennas.

BACKGROUND OF THE INVENTION

In response to the federal mandate requiring a transition from NTSC television transmission to digital television ("DTV") transmission, and the need to continue providing NTSC service, broadcasters have begun adding DTV antennas to existing antenna towers. Due to the limited number of existing antenna towers and, owing to the geographical limitations imposed by "line of sight" transmission requirements, the limited locations available in many areas for additional towers the addition of antennas is not without problems.

A first problem resulting from the transition to DTV is the limited amount of "real estate" on existing towers. A tower on which a DTV antenna is to be added is likely to have a number of UHF and VHF antennas already mounted on it along with a number of AM, FM and cellular telephone antennas. Continual efforts are being made to improve the design of antennas to reduce size to decrease weight and wind load. By reducing weight and wind load, an increased number of antennas can be mounted on existing towers.

A second problem that exists is that, under existing practices, each antenna is fed by a separate feed line. The feed lines can be of the wave guide or coaxial structure type but the coaxial structure type is preferred as it causes less wind load and does not cause group delay distortion on the signal as does a waveguide structure. Notwithstanding this, because the coaxial feed lines are required to handle high power, e.g., 50 kW, the inner and outer conductors must be sufficiently large to handle this load and thus still cause significant wind load While improvements in antenna design can greatly increase the number of antennas that can be supported by a tower, it would be beneficial to be able to feed multiple antennas utilizing a single feed line thereby further increasing the wind load capacity of the tower. As described below, attempts have been made to solve this problem.

U.S. Pat. No. 5,774,193 uses a signal combiner to combine the NTSC and DTV signals to form a composite signal that is fed up the transmission line. A signal separator disposed at the upper end of the transmission line separates the composite signal into the DTV signal and NTSC signal for application to the DTV and NTSC antennas. The signal separator is formed of a high pass filter and a low pass filter. The high pass filter passes an ultra high frequency (UHF) DTV signal to the DTV antenna, but rejects a very high frequency (VHF) NTSC signal. The low pass filter passes the VHF NTSC signal to the NTSC antenna, but rejects the UHF DTV signal. The high and low pass filter separator may provide adequate bandwidth and rejection for the case of the DTV signal and the NTSC signal being in two different frequency bands. However, it does not provide adequate rejection for the case where the carrier frequencies of the two signals are relatively close together as, for example, in the same frequency band. Another problem which exists in the foregoing system is the significant additional wind load caused by the high pass filter cross section.

It would therefore be advantageous to provide an antenna feed system capable of feeding more than one antenna with a single feed line that does not require the use of a high pass filter.

SUMMARY OF THE INVENTION

The foregoing needs have been satisfied to a great extent by the present invention which, in one aspect, is a broadcast antenna feed system. The feed system includes a tower antenna feed line and a signal splitter having a first terminal connected to the tower antenna feed line. A first antenna is connected to a second terminal of the splitter and a second antenna is connected to a third terminal of the splitter. The first antenna is tuned to a first carrier frequency and the second antenna is tuned to a second carrier frequency.

The splitter includes a first filter for filtering signals to the first antenna and a second filter for filtering signals to the second antenna. The filters can be bandpass filters, lowpass filters, or band notch filters depending on what type of signals are combined in the signal transmitted to the splitter over the feed line.

In another aspect of the invention, an antenna feed system is provided which includes feeder means for transmitting a feed signal containing first and second broadcast signals to a splitter means. The splitter means is connected to the feeder means to separate out a first and second broadcast transmission signal from the feed signal. A first transmission means and a second transmission means on a broadcast tower are also provided for, respectively, transmitting the first and second broadcast transmission signals.

In yet another aspect of the invention, a method of feeding broadcast antennas is provided. The method includes the steps of feeding a signal containing first and second broadcast signals to a splitter on an antenna tower. The signal is then split into a first and second broadcast transmission signal at the splitter. The first broadcast signal is transmitted over a first antenna and the second broadcast signal is transmitted over a second antenna.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purposes of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

DETAILED DESCRIPTION OF PREFERRED EMBODIMENTS OF THE INVENTION

Figure 1:
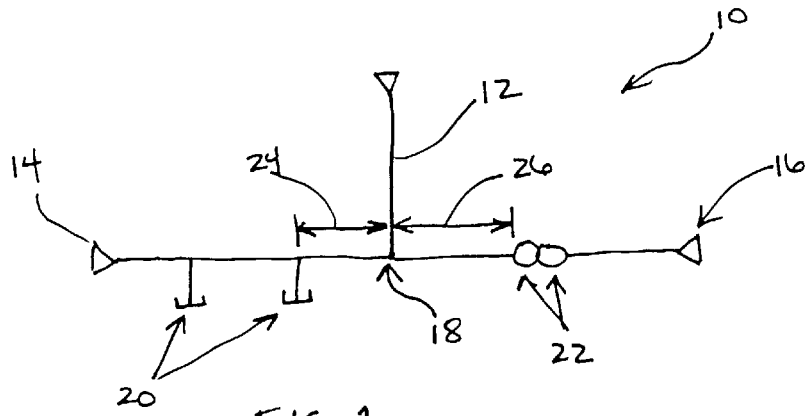
FIG. 1 is a representation of an antenna feed system in accordance with a first preferred embodiment of the present invention.

Referring now to the figures wherein like reference numerals indicate like elements, in FIG. 1 there is shown a representation of an antenna feed system 10 for supplying both a VHF and UHF antenna with the same feed line 12. In the antenna feed system 10 broadcast signals are fed from one or more transmitters (not shown) to the tower antennas 14, 16 through the feed line 12. In the preferred embodiment the feed line is a coaxial structure type.

The broadcast signals are received at a combiner. Details of the construction of the combiner are provided in co-pending application Ser. No. 09/639,322, the disclosure of which is incorporated herein by reference. In the preferred embodiment, the combiner is a starpoint combiner the details of which are well documented and understood.

In order to filter out the UHF signal so that only the VHF signal is fed to antenna 14, the signal is fed to a tee or splitter 18. At the output of the splitter 18 that is feeding antenna 14 is a reflective notch filter. In order to provide the correct frequency response to filter out the UHF signal channel it may be necessary, as is shown, to provide multiple notch filter operating together to attenuate a desired channel band. Similarly, in order to filter out the VHF channel and thus provide only the UHF signal to antenna 16, a bandpass filter 22 would be provided at the output of the splitter 18 feeding antenna 16. Again, it may be necessary to provide multiple bandpass filters operating together to obtain the frequency response necessary to pass the UHF channel with minimal attenuation.

In the antenna feed system of FIG. 1, the length between the connecting 18 and the notch filter 24 is phased so that the notch filters reflect as an open circuit at the common junction. For open circuit notches this length 24 is equal to one half the wavelength of the UHF carrier frequency. For short circuit notches the length 24 is equal to one quarter of the UHF carrier frequency wavelength. The spacing between the notch filters, where multiple notch filters are used, is approximately one quarter of the wavelength of the VHF carrier frequency so that a good match at the VHF channels is achieved.

Similarly, the length from the tee 18 to the bandpass filter 22 is phased so that that bandpass filters reflect as an open circuit at the common junctions. For open circuit bandpass filters the length 26 is equal to one half the carrier frequency wavelength of the VHF channel. For short circuited bandpass filters the length 26 is equal to one quarter of the wavelength of the carrier frequency of the VHF channel.

Figure 2:
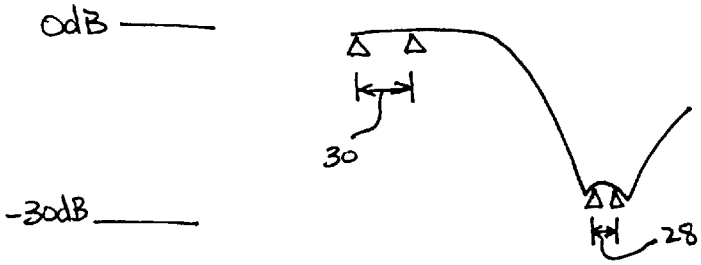
FIG. 2 is a representation of the frequency response characteristics of a notch filter of the antenna feed system of FIG. 1.
Figure 3:
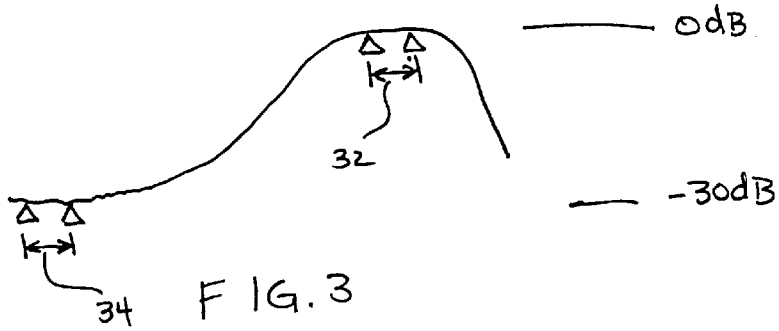
FIG. 3 is a representation of the frequency response characteristics of a bandpass filter of the antenna feed system of FIG. 1.

As depicted in FIG. 2, the notch filter 20 provides greater than thirty decibels of attenuation across the UHF channel 28 with minimal attenuation across the VHF channel 30. Conversely, as depicted in FIG. 3, the bandpass filter 22 provides minimal attenuation across the UHF channel 32 with greater than thirty decibels of attenuation across the VHF channel 34. It should be noted that this same configuration of a notch filter and a bandpass filter can be used to combine a UHF channel with a VHF channel or an FM channel.

Figure 4:
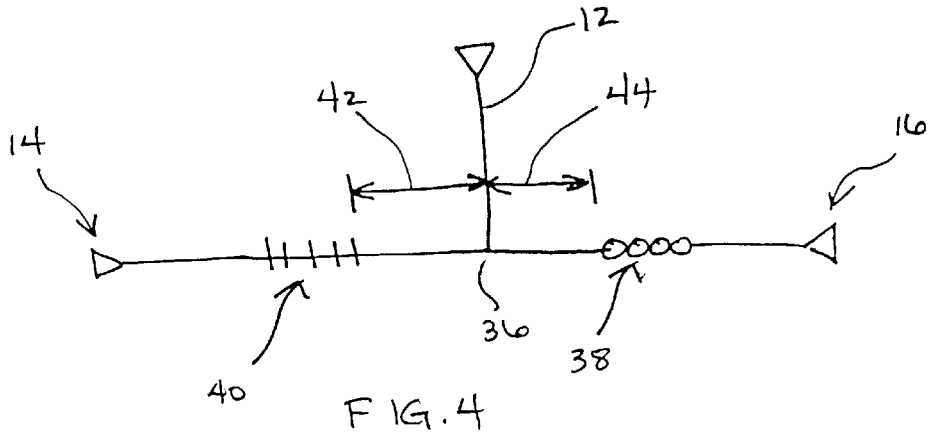
FIG. 4 is a representation of an antenna feed system in accordance with a second preferred embodiment of the present invention.

An alternative embodiment of antenna feed system for combining a UHF channel with a VHF or FM channel is depicted in FIG. 4 wherein the feed line 12 feeds the splitter 36. A bandpass filter 38 is provided at one output of the splitter 36, as in the embodiment of FIG. 1, to supply the UHF channel to antenna 16. A lowpass filter 40 is provided at a second output of the splitter 36 to filter out the UHF channel thereby providing only the VHF or FM channel to the antenna 14.

In the antenna feed system of FIG. 4, the length between the connecting tee 36 and the lowpass filter 40 is phased so that the lowpass filters reflect as an open circuit at the common junction. For open circuit lowpass filter this length 42 is equal to one half the wavelength of the UHF carrier frequency. For short circuit lowpass filter the length 42 is equal to one quarter of the UHF carrier frequency wavelength. The spacing between the lowpass filters, where multiple lowpass filters are used, is approximately one quarter of the wavelength of the VHF carrier frequency so that a good match at the VHF channels is achieved.

As described above in connection with FIG. 1, the length 44 from the connecting tee 36 to the bandpass filter 38 is phased so that that bandpass filters reflect as an open circuit at the common junctions. For open circuit bandpass filters the length 44 is equal to one half the carrier frequency wavelength of the VHF channel. For short circuited bandpass filters the length 44 is equal to one quarter of the wavelength of the carrier frequency of the VHF channel.

Figure 5:
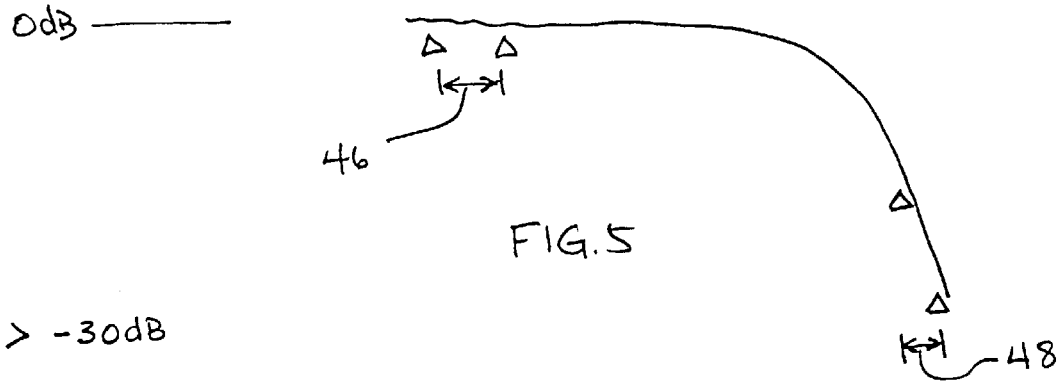
FIG. 5 is a a representation of the frequency response characteristics of a lowpass filter of the antenna feed system of FIG. 4.
Figure 6:
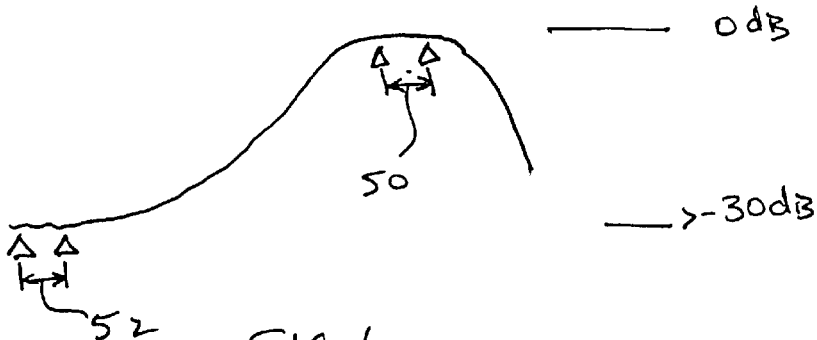
FIG. 6 is a representation of the frequency response characteristics of a bandpass filter of the antenna feed system of FIG. 4.

A representation of the frequency response of the lowpass filter 40 of FIG. 4 is provided in FIG. 5. As is depicted, the VHF or FM channel 46 is minimally attenuated while the UHF channel 48 is subject to greater than thirty decibels of attenuation. Conversely, the bandpass filter 38 minimally attenuates the UHF channel while the FM or VHF channel is subjected to greater than thirty decibels of attenuation.

Figure 7:
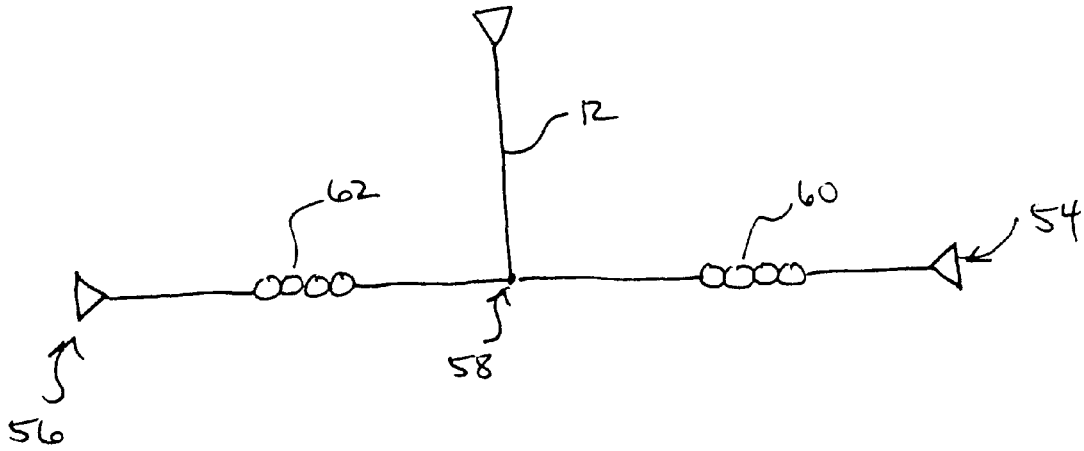
FIG. 7 is a representation of an antenna feed system in accordance with a third preferred embodiment of the present invention.

In another alternate embodiment of the invention, as depicted in FIG. 7, the antenna feed line 12 can be used to feed two UHF antennas 54, 56. In this embodiment, both outputs of the splitter 58 are provided with band pass filters 60, 62. It should be understood that the bandpass filters of this embodiment are functionally as described above in connection with FIGS. 1–4 but pass different channels. It also should be recognized that the two UHF channels should be widely spaced channels in order to avoid channel interference resulting from insufficient attenuation at the channel boundaries.

In this embodiment, the bandpass filters are broadly tuned so that they can use fixed tuning and not be sensitive to the environment. In a preferred embodiment the splitter 58 and filters would be incorporated into a starpoint type combiner. The splitter 58 would use correct phase lines between the junction and the filters.

Figure 8:
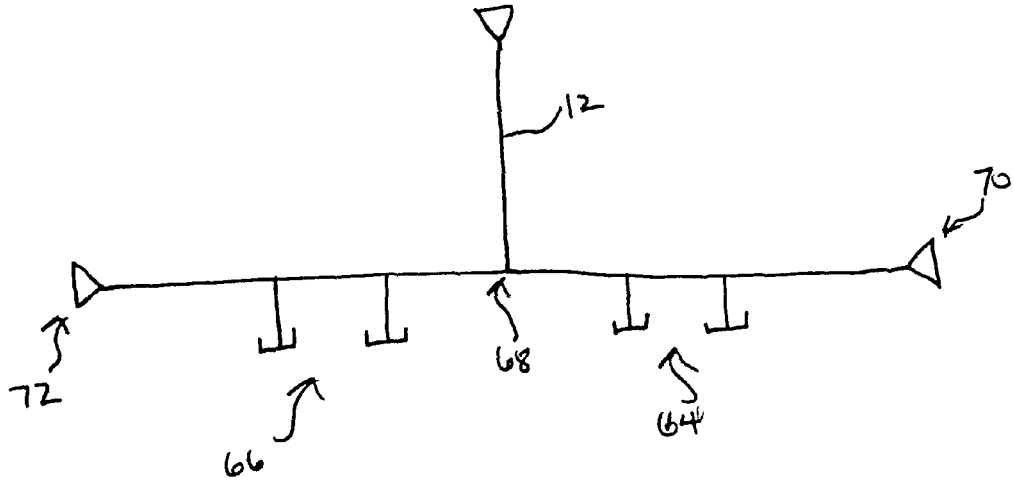
FIG. 8 is a representation of an antenna feed system in accordance with a fourth preferred embodiment of the present invention.

As depicted in FIG. 8, yet another embodiment of the channel feed system employs two notch filters 64, 66 at the outputs of the splitter 68 in order to feed antennas 70, 72, respectively. The notch filters 64, 66 are each tuned to attenuate one of the channels on the feed line 12. This embodiment would be useable when the channels are very widely spaced so that wide stop bands can be obtained from the notches. For more closely spaced channels, more than two sections of notch filters may be required to achieve the desired frequency response to separate the signals.

The above description and drawings are only illustrative of preferred embodiments which achieve the objects, features, and advantages of the present invention, and it is not intended that the present invention be limited thereto. Any modification of the present invention which comes within the spirit and scope of the following claims is considered to be part of the present invention.

What is claimed is:

1. A broadcast antenna feed system supporting two broadcast frequencies, comprising:

a tower antenna feed line;

a signal splitter having a first terminal connected to said tower antenna feed line;

a first antenna tuned to radiate at a first UHF frequency;

a second antenna tuned to radiate at a second UHF frequency;

a first filter, tuned to the first frequency, interposed between said splitter and said first antenna;

a second filter, tuned to the second frequency, interposed between said splitter and said second antenna;

a first transmission line segment having a length that constitutes an integer number of quarter wavelengths of the first frequency, connecting a second terminal of said splitter to a first terminal of said first filter;

a second transmission line segment having a length that constitutes an integer number of quarter wavelengths of the second frequency, connecting a third terminal of said splitter to a first terminal of said second filter;

a third transmission line segment having a length that satisfies the interconnection requirements between a second terminal of said first filter and an input port of said first antenna; and a fourth transmission line segment having a length that satisfies the interconnection requirements between a second terminal of said second filter and an input port of said second antenna.

2. The broadcast antenna feed system claim 1, wherein said first filter is a bandpass filter.

3. The broadcast antenna feed system of claim 2, wherein the integer number of quarter wavelengths in said first transmission line segment is an odd number.

4. The broadcast antenna feed system of claim 3, wherein the integer number of quarter wavelengths in said first transmission line segment is one quarter wavelength.

5. The broadcast antenna feed system of claim 4, wherein said second filter is a reflective notch filter.

6. The broadcast antenna feed system of claim 5, wherein the integer number of quarter wavelengths in said second transmission line segment is an even number.

7. The broadcast antenna feed system of claim 6, wherein the integer number of quarter wavelengths in said second transmission line segment totals one half wavelength.

8. The broadcast antenna feed system of claim 4, wherein said second filter is a second bandpass filter.

9. The broadcast antenna feed system of claim 8, wherein the integer number of quarter wavelengths in said second transmission line segment is an odd number.

10. The broadcast antenna feed system of claim 9, wherein the integer number of quarter wavelengths in said second transmission line segment is one quarter wavelength.

11. A broadcast antenna feed system supporting two broadcast frequencies, comprising:

feeder means, for transmitting a shared feed signal containing first and second broadcast signals;

splitter means, for directing first and second broadcast signals to filtering means by which they will be separated;

first and second radiating means on a broadcast tower, for radiating, respectively, first and second broadcast signals following separation;

first and second filtering means, for extracting, respectively, first and second broadcast signals from the shared feed signal;

first multi-quarter-wave conductive means, for carrying the shared feed signal to said first filtering means, through which means the first broadcast signal will pass, the shared feed signal interacting with the second broadcast signal causing the antenna load reflected back to appear as a nonexistent circuit element;

second multi-quarter-wave conductive means, for carrying the shared feed signal to said second filtering means, third and fourth conductive means, for carrying, respectively, the first and second broadcast signals from their respective filtering means output ports to their respective radiating means.

12. The broadcast antenna feed system of claim 11, wherein said first filtering means performs bandpass filtering.

13. The broadcast antenna feed system of claim 12, wherein said second filtering means performs bandpass filtering.

14. The broadcast antenna feed system of claim 13, wherein said second multi-quarter-wavelength conductive means carries the feed signal to said second filtering means, through which the second broadcast signal will pass, while said second multi-quarter-wavelength conductive means so interacts with the first broadcast signal as to cause said second filtering means to appear thereto as a nonexistent circuit element.

15. The broadcast antenna feed system of claim 12, wherein said second filtering means performs reflective notch filtering.

16. The broadcast antenna feed system of claim 15, wherein said second multi-quarter-wavelength conductive means carries the feed signal to said second filtering means past which the second broadcast signal will pass, while said second multi-quarter-wavelength conductive means so interacts with the first broadcast signal as to allow said second filtering means to appear thereto as a nonexistent circuit element.

17. The broadcast antenna feed system of claim 11, wherein said first filter passes a first UHF signal and wherein said second filter passes a second UHF signal.

* * * * *